US011783794B2

(12) United States Patent
Li et al.

(10) Patent No.: US 11,783,794 B2
(45) Date of Patent: Oct. 10, 2023

(54) DISPLAY DEVICE AND DISPLAY PANEL THEREOF

(71) Applicants: HKC CORPORATION LIMITED, Shenzhen (CN); CHONGQING HKC OPTOELECTRONICS TECHNOLOGY CO., LTD., Chongqing (CN)

(72) Inventors: Wenxin Li, Chongqing (CN); Xiaoyu Huang, Chongqing (CN)

(73) Assignees: HKC CORPORATION LIMITED, Shenzhen (CN); CHONGQING HKC OPTOELECTRONICS TECHNOLOGY CO., LTD, Chongqing (CN)

( * ) Notice: Subject to any disclaimer, the term of this patent is extended or adjusted under 35 U.S.C. 154(b) by 399 days.

(21) Appl. No.: 17/262,216

(22) PCT Filed: Dec. 3, 2018

(86) PCT No.: PCT/CN2018/119019
§ 371 (c)(1),
(2) Date: Sep. 10, 2021

(87) PCT Pub. No.: WO2020/019621
PCT Pub. Date: Jan. 30, 2020

(65) Prior Publication Data

US 2022/0180833 A1 Jun. 9, 2022

(30) Foreign Application Priority Data

Jul. 24, 2018 (CN) ..... 201810816838.6

(51) Int. Cl.
*G09G 3/36* (2006.01)

(52) U.S. Cl.
CPC ... *G09G 3/3674* (2013.01); *G09G 2310/0202* (2013.01); *G09G 2310/0291* (2013.01)

(58) Field of Classification Search
CPC ..... G09G 3/3674; G09G 2310/0202; G09G 2310/0291; G09G 2310/02;
(Continued)

(56) References Cited

U.S. PATENT DOCUMENTS 6,624,801 B2 * 9/2003 Moriyama ..... G09G 3/36 345/103
7,692,611 B2 * 4/2010 Jo ..... G09G 3/3233 345/82
(Continued)

FOREIGN PATENT DOCUMENTS

CN 1450510 A 10/2003
CN 1664739 A 9/2005
(Continued)

OTHER PUBLICATIONS

Lisheng Wang, the ISA written comments, May 2019, CN.
Lisheng Wang, the International Search Report, May 2019, CN.

*Primary Examiner* — Temesghen Ghebretinsae
*Assistant Examiner* — K. Kiyabu

(57) ABSTRACT

A display panel is provided. The display panel includes a display area, a driver transistor array substrate, a plurality of scanning lines and a control electrode driver chip. The driver transistor array substrate and the plurality of scanning lines are located on the display area; each of the scanning lines is connected to at least one driver transistor; the control electrode driver chip is connected to the scanning lines through output ports; the display area is divided into a first display area and a second display area according to one diagonal line of the driver transistor array substrate; the control electrode driver chip includes a plurality of amplifying circuits, each output port of the control electrode
(Continued)

driver chip is for controlling at least one scanning line, and each output port with the number of controlled pixel greater than a first preset value is connected to the scanning line through one amplifying circuit.

20 Claims, 3 Drawing Sheets

(58) Field of Classification Search
CPC ... G09G 2310/0221; G09G 2320/0223; G09G 3/3677
See application file for complete search history.

(56) References Cited

U.S. PATENT DOCUMENTS 7,868,865 B2 * 1/2011 Shin ..... G09G 3/3233 345/97
10,114,261 B2 * 10/2018 Huang ..... G09G 3/36
10,431,172 B2 * 10/2019 Kim ..... G09G 3/3648
10,976,845 B2 * 4/2021 Wang ..... G06F 3/0412
2005/0052439 A1 * 3/2005 Liou ..... G09G 3/20 345/204
2006/0267889 A1 * 11/2006 Kimura ..... G09G 3/3258 345/84
2015/0262554 A1 * 9/2015 Park ..... G09G 3/20 345/212
2015/0348455 A1 * 12/2015 Jeon ..... G02F 1/134336 345/55
2023/0128359 A1 * 4/2023 Pfeiffer ..... G09G 3/3611 345/214

FOREIGN PATENT DOCUMENTS

CN 102610201 A 7/2012
CN 105303975 A 2/2016
CN 106356032 A 1/2017
CN 107993626 A * 5/2018
CN 108010920 A * 5/2018 ..... G09G 3/20
CN 109003584 A 12/2018
CN 113724604 A * 11/2021

* cited by examiner

DISPLAY DEVICE AND DISPLAY PANEL THEREOF

The present application claims the priority to the Chinese Patent Application No. CN201810816838.6, filed with the National Intellectual Property Administration, PRC on Jul. 24, 2018 and entitled "DISPLAY DEVICE AND DISPLAY PANEL THEREOF", which is incorporated herein by reference in its entirety.

TECHNICAL FIELD

The present application relates to the technical field of display, particular to a display device and a display panel thereof.

BACKGROUND

The statements herein merely provide background information related to the present application and do not necessarily constitute the conventional art.

TFT-LCD (Thin Film Transistor Liquid Crystal Display) is one of the major forms of panel display at present. The TFT-LCD has become an important display platform in modern IT and video products. At present, the driving method of the scanning drive circuit used in the TFT-LCD is progressive scanning. In order to avoid insufficient charging time caused by the scanning lines not being switched on or not being fully switched on, an operational amplifier is usually configured to each output port in the scanning drive circuit to increase driving capability. For example, 768 scanning lines (corresponding to a 1024*768 display panel) require 768 operational amplifiers. Thus, the manufacturing cost is greatly increased.

SUMMARY

According to embodiments of the present application, a display device and a display panel thereof are provided.

A display panel includes a display area, a driver transistor array substrate, a plurality of scanning lines and a control electrode driver chip. The driver transistor array substrate and the plurality of scanning lines are located on the display area, each scanning line is connected to at least one driver transistor to control pixels respectively driven by the driver transistors, and the display area is divided into a first display area and a second display area according to one diagonal line of the driver transistor array substrate. The control electrode driver chip includes a plurality of amplifying circuits, and is connected to the scanning lines through output ports, each output port is for controlling at least one scanning line, and each output port with the number of controlled pixel greater than a first preset value is connected to the scanning line through one amplifying circuit, while each output port with the number of controlled pixel less than or equal to the first preset value is not connected to the scanning line through the amplifying circuit.

In one or more embodiments, the plurality of scanning lines include a first scanning line located on the diagonal line, the first scanning line is for driving the pixels on the diagonal line of the driver transistor array substrate; both ends of the diagonal line intersect with the edge of the driver transistor array substrate, the pixels at the intersections are pixels driven by the starting point of the first scanning line and pixels driven by the end point of the first scanning line, and the first scanning line is connected to the control electrode of one driver transistor among each row of driver transistors.

In one or more embodiments, the pixels driven by each scanning line are arranged into line segments, and the line segments are parallel to one another; the pixels at both ends of each line segment are respectively located at the edge of one side of the first display area or the edge of one side of the second display area; the intervals of the pixels in the identical row driven by two adjacent scanning lines among the scanning lines on both sides of the diagonal line are equal; and each output port of the control electrode driver chip controls two scanning lines.

In one or more embodiments, each output port is for controlling a pair of scanning lines; and each pair of scanning lines includes a second scanning line for driving the pixels located in the first display area, and a third scanning line for driving the pixels located in the second display area.

In one or more embodiments, the two scanning lines in each pair drive the identical number of pixels.

In one or more embodiments, the amplifying circuit includes an operational amplifier.

In one or more embodiments, the display panel further includes a plurality of control electrode control chips; each control electrode control chip is respectively connected to one scanning line and one output port of the control electrode driver chip; and the control electrode control chip receives the driving signal of the control electrode driver chip so as to control the corresponding pixels.

In one or more embodiments, the number of the scanning lines in the first display area is equal to that of the scanning lines in the second display area.

In one or more embodiments, the control electrode driver chip is a gate driver chip.

A display panel includes a display area, a driver transistor array substrate, a plurality of scanning lines and a gate driver chip. The driver transistor array substrate and the plurality of scanning lines are located on the display area, and each scanning line is connected to at least one driver transistor to control the pixels respectively driven by the driver transistors; the display area is divided into a first display area and a second display area according to one diagonal line of the driver transistor array substrate; the pixels driven by each scanning line are arranged into line segments, and the line segments are all parallel to one another, and the pixels at both ends of each line segment are respectively located on the edge of one side of the first display area or the edge of one side of the second display area. The gate driver chip includes a plurality of amplifying circuits for enhancing the driving capability of signals output to the scanning lines by the output ports; each output port of the gate driver chip is for controlling two scanning lines; and each output port with the number of controlled pixel greater than a first preset value is connected to the scanning line through one amplifying circuit, while each output port with the number of controlled pixel less than or equal to the first preset value is not connected to the scanning line through the amplifying circuit.

A display device includes a display control circuit, a display panel and a control electrode driver chip. The display control circuit is connected to the display panel to control the display panel. The display panel includes a display area, a driver transistor array substrate, a plurality of scanning lines and a control electrode driver chip. The driver transistor array substrate and the plurality of scanning lines are located on the display area, each scanning line is connected to at least one driver transistor, and the display area is divided into a first display area and a second display area according to one diagonal line of the driver transistor array substrate. The control electrode driver chip includes a plurality of amplifying circuits, and is connected to the scanning lines through output ports, each output port is for controlling at least one scanning line, and each output port with the number of controlled pixel greater than a first preset value is connected to the scanning line through one amplifying circuit, while each output port with the number of controlled pixel less than or equal to the first preset value is not connected to the scanning line through the amplifying circuit.

In the aforementioned display device and display panel thereof, each output port of the control electrode driver chip (e.g., a gate driver chip) is for controlling at least one scanning line, and when the number of the pixels controlled by the scanning line is greater than a first preset value, the output port of the control electrode driver chip is connected to the scanning line through one amplifying circuit. Compared with the display panel in which the scanning lines are transversely arranged and the output port of the control electrode driver chip connected to each scanning line is connected to the scanning line through an amplifying circuit in the exemplary technology, the display panel has less amplifying circuits in the control electrode driver chip, reducing the manufacturing cost of the display panel.

DETAILED DESCRIPTION OF EMBODIMENTS

In order to make the objects, technical solutions and advantages of the present application more clearly understood, the present application is further described in detail below with reference to the drawings and embodiments. It should be understood that the specific embodiments described herein are merely illustrative of the present application and are not intended to limit the present application.

Figure 1:
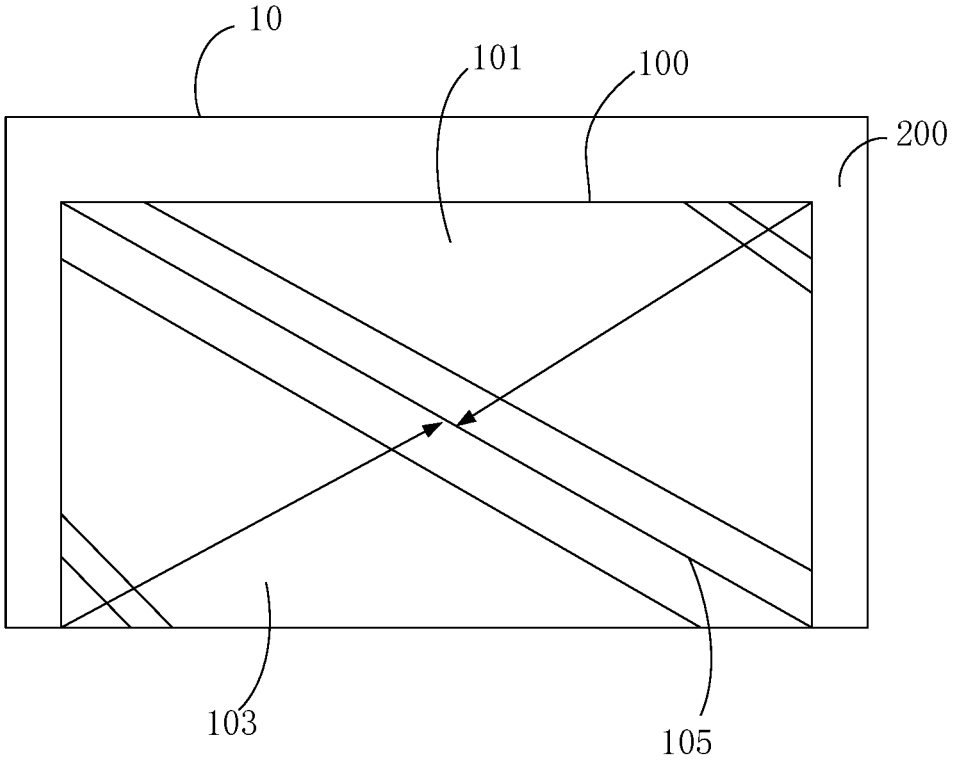
FIG. 1 is a structural block diagram of a display panel according to an embodiment.

As shown in FIG. 1, a display panel 10 includes a display area 100, a driver transistor array substrate, a plurality of scanning lines and an edge area 200. The edge area 200 surrounds the outside of the display area 100. The driver transistor array substrate and the plurality of scanning lines are located on the display area. Each scanning line is respectively connected to the control electrode of at least one driver transistor to control pixels respectively driven by the driver transistors, and each scanning line is connected to one driver transistor different from those connected to the other scanning lines. In one or more embodiments, the control electrode is the gate of the driver transistor. The display area 100 is divided into a first display area and a second display area according to a first scanning line. The pixels driven by the starting point and end point of the first scanning line are respectively pixels at the intersections between a diagonal line of the driver transistor array substrate and the edge of the driver transistor array substrate, and the first scanning line is connected to the control electrode of one driver transistor among each row of driver transistors. The intervals between the pixels in the identical row driven by two adjacent scanning lines among the rest of the scanning lines are equal. In the present embodiment, the first scanning line is a scanning line for driving the pixels on the diagonal line of the driver transistor array substrate. In the present embodiment, the driver transistor array substrate in the display area 100 is divided into a first display area 101 and a second display area 103 according to a diagonal line 105. The pixels driven by each scanning line are arranged into line segments, and the line segments are all parallel. The pixels at both ends of each line segment are respectively located at the edge of one side of the first display area 101 or the edge of one side of the second display area 103.

The display panel 10 further includes a control electrode driver chip. In one or more embodiments, the control electrode driver chip is a gate driver chip (not shown). The gate driver chip is connected to each scanning line in the display area 100 through an output port to output a driving control signal to control the scanning line and control the pixels driven by the driver transistor through the scanning line. The gate driver chip includes amplifying circuits for enhancing the driving capability of signals output to the scanning lines by the output ports. Each output port of the gate driver chip is at least for controlling one scanning line, and each output port with the number of controlled pixel greater than a first preset value is connected to the scanning line through one amplifying circuit, while each output port with the number of controlled pixel less than or equal to the first preset value is not connected to the scanning line through the amplifying circuit. In the present embodiment, each output port of the gate driver chip is for controlling two scanning lines. The first preset value is a value set according to actual conditions. For example, when the number of the pixels driven by one scanning line is greater than the first preset value, if no amplifying circuit exists in the circuit connecting the gate driver chip and the scanning line, the control electrode driver chip will have insufficient driving capability to switch on or fully switch on the scanning line. When the number of the pixels driven by one scanning line is less than or equal to the first preset value, the scanning line can be fully switched on without connecting an amplifying circuit into the circuit connecting the gate driver chip and the scanning line to enhance the driving capability of signals of the scanning line. The amplifying circuit includes an operational amplifier. When the number of the pixels driven by one scanning line is greater than the first preset value, the output port of the gate driver chip is connected to the scanning line through one operational amplifier so as to enhance the driving capability of signals output to the scanning line by the output port.

In the aforementioned display panel 10, each output port of the gate driver chip is for controlling two scanning lines, and when the number of the pixels controlled by one scanning line is greater than the first preset value, the output port of the gate driver chip is connected to the scanning line through one amplifying circuit. When the number of the pixels controlled by one scanning line is less than or equal to the first preset value, the output port of the gate driver chip does not need to be connected to the scanning line through one amplifying circuit. Therefore, compared with the display panel in which the scanning lines are transversely arranged and the output port of the gate driver chip connected to each scanning line is connected to the scanning line through an amplifying circuit in the exemplary technology, the display panel has less amplifying circuits in the gate driver chip, thus reducing the manufacturing cost of the display panel. Moreover, in the display panel 10, the number of the pixels which are driven to be switched on by the scanning lines connected to the output ports in the gate driver chips without amplifying circuits is small, therefore, the pixel charging time is sufficient, and the picture display effect is good.

In one or more embodiments, each output port of the gate driver chip is for controlling a pair of scanning lines. Each pair of scanning lines include a scanning line located in the first display area 101 and a scanning line located in the second display area 103. The two scanning lines in each pair drive the identical number of pixels. Therefore, compared with the display panel in which the scanning lines are transversely arranged and the output port of the gate driver chip connected to each scanning line is connected to the scanning line through an amplifying circuit in the exemplary technology, the display panel has less amplifying circuits in the gate driver chip, thus reducing the manufacturing cost of the display panel 10.

In the present embodiment, the number of the scanning lines in the first display area 101 and the number of the scanning lines in the second display area 103 are equal. The number of the pixels driven by each scanning line in the display area 101 and the display area 103 is gradually reduced in a direction away from the diagonal line 105.

Figure 2:
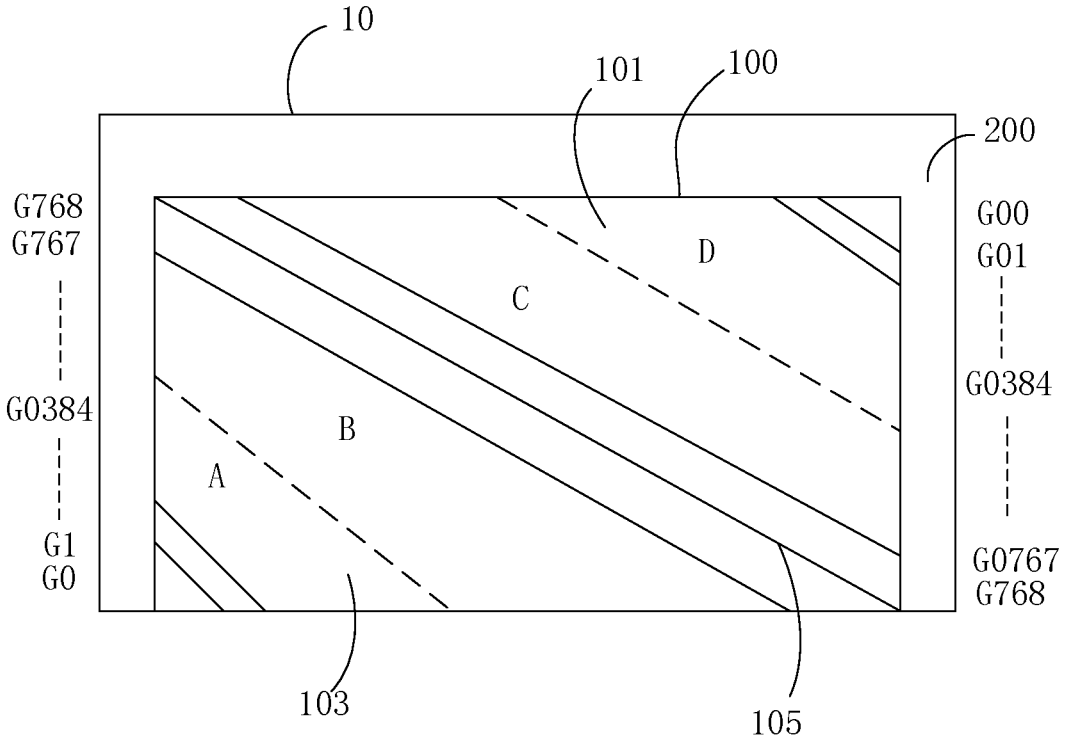
FIG. 2 is a structural block diagram of a display panel according to another embodiments.

In one or more embodiments, as shown in FIG. 2, the number of the scanning lines in the first display area 101 is 768. The number of the scanning lines in the second display area 103 is 768 (neither the first display area 101 nor the second display area 103 sets with the diagonal line 105). The display area 100 further sets with scanning lines on the diagonal line 105. The pixels driven by each scanning line in the first display area 101 and the second display area 103 are arranged into line segments, and the line segments are all parallel. The pixels at both ends of each line segment are respectively located at the edge of one side of the first display area 101 or the edge of one side of the second display area 103. Each scanning line in the first display area 101 and the second display area 103 is parallel to the diagonal line 105. Furthermore, the number of the pixels driven each scanning line in the first display area 101 and the second display area 103 is gradually increased in a direction approaching the diagonal line 105 from the end away from the diagonal line 105. Each scanning line in the display area 100 is respectively connected to a gate control chip. As shown in FIG. 2, the first display area 101 includes gate control chips G00 to G0767. Each gate control chip in the first display area 101 is further respectively connected to one gate driver chip to acquire a driving signal from the gate driver chip, so that the driver transistors connected to the corresponding scanning lines can be controlled to be switched on and off. The second display area 103 includes gate control chips G0 to G767. Each gate control chip in the second display area 103 is respectively connected to one gate driver chip to acquire a driving signal from the gate driver chip, so that the driver transistors connected to the corresponding scanning lines can be controlled to be switched on and off. Unlike the transverse arrangement of the scanning lines of the exemplary technology, the scanning lines in the display area 100 are arranged in parallel to the diagonal line 105. It starts from the scanning line connected to the gate control chip G0 and the gate control chip G00 to the scanning line connected to the gate control chip G767 and the gate control chip G0767 (the scanning line connected to the gate control chip G767 drives 1366 pixels, i.e., 4098 sub-pixels). The scanning line connected to the gate control chip G0 and the gate control chip G00 only needs to switch on one sub-pixel, so there is no need to worry about the voltage distortion problem of switching-on. By analogy, until the scanning line connected to the 384th gate control chip G384 and the 384th gate control chip G0384, there is no need to worry about the problem of insufficient charging time caused by the driver transistor not being fully switched on due to waveform distortion. That is, the scanning lines connected to the gate control chips G0 to G384 and the gate control chips G00 to G0384 do not require operational amplifiers to be for increasing the driving capability of the gate driver chips for the signals of the scanning lines. The scanning lines connected to the gate control chips G385 to G767 and the gate control chips G0385 to G0767 require operational amplifiers to be for the gate driver chips to increase the driving capability of the gate driver chips for the signals of the scanning lines. In the present embodiment, the gate control chips G0 to G767 and the gate control chips G00 to G0767 are connected to and controlled by the identical gate driver chip. The scanning lines with the identical number of controlled pixel are connected to the identical output port of the gate driver chip through the corresponding gate control chip. When the number of the pixels controlled by one scanning line reaches a certain value, the output port of the gate driver chip is connected to the corresponding gate control chip through the operational amplifier. In the present embodiment, the output ports of the gate driver chips are individually connected to the scanning lines on the diagonal line 105 through the operational amplifiers. That is, in the present embodiment, no operational amplifier exists on the ports of the gate driver chips respectively connected to the gate control chips G0 (G00) to G384 (G0384). The output ports of the gate driver chip connected to the gate control chips G385 (G0385) to G768 (G0767) are respectively connected to an operational amplifier to drive the pixels on the corresponding scanning lines to be switched on. Compared with the display panel with the scanning lines arranged transversely in the exemplary technology, the display panel can save half of the operational amplifiers, thus reducing the manufacturing cost of the display panel.

In the present embodiment, as shown in FIG. 2, the pixels correspondingly driven by the scanning line controlled by the gate control chip G0 through the scanning line controlled by the gate control chip G384 are the pixels in a region A. The pixels correspondingly driven by the scanning line controlled by the gate control chip G385 through the scanning line controlled by the gate control chip G768 are the pixels in a region B. The pixels correspondingly driven by the scanning line controlled by the gate control chip G00 through the scanning line controlled by the gate control chip G0384 are the pixels in a region D. The pixels correspondingly driven by the scanning line controlled by the gate control chip G0385 through the scanning line controlled by the gate control chip G0767 are the pixels in a region C. In the region A and the region D, the number of the pixels connected to each scanning line is small, operational amplifiers do not need to be for the gate driver chips to enhance the driving capability of signals of the corresponding scanning lines, there is enough time to switch on the pixels on the corresponding scanning lines, and the picture display effect of the corresponding regions is good. In the region B and the region C, the output port of the gate driver chip corresponding to each scanning line requires an operational amplifier to for enhancing the driving capability of signals of the corresponding scanning line. Compared with the conventional display panel in which the scanning lines are transversely arranged and the gate driver chip is connected to two scanning lines through the output port connected to the operational amplifier, the display panel has less total number of pixels driven by the scanning line connected to each output port. Therefore, the charging effect is good, and the picture display effect of the region C and the region D is also better.

Figure 3:
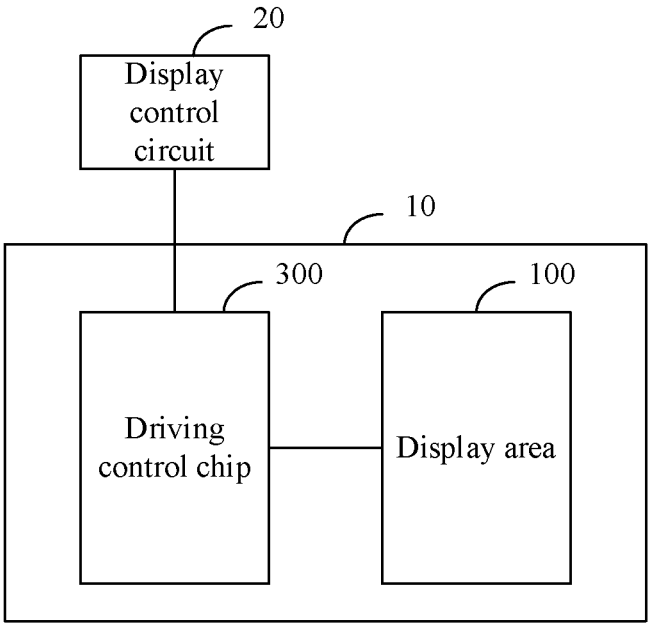
FIG. 3 is a structural block diagram of a display device according to an embodiment.

The present application further provides a display device. As shown in FIG. 3, the display device includes a display panel 10 and a display control circuit 20. The display panel 10 is the display panel according to any of the aforementioned embodiments. The display panel 10 includes a display area 100 and a driving control chip 300. The driving control chip 300 is connected to the display area 100 to control the display of the display area 100. The display control circuit 20 is connected to the driving control chip 300 in the display panel 10. The display control circuit 20 controls the display of the display area 100 by driving control chip 300.

In other embodiments, the display device may be any type of display device, such as an LCD (Liquid Crystal Display), an OLED (Organic Electroluminesence Display), a QLED (Quantum Dot Light Emitting diode) Display, a curved display, or the like.

The technical features of the embodiments described above can be combined arbitrarily. For the sake of brevity, all possible combinations of the technical features of the above embodiments are not described, and such combinations of the technical features shall be deemed to fall within the scope of the present disclosure as long as there is no contradiction.

The embodiments described above only describe several implementations of the present application, and the description thereof is specific and detailed. However, those cannot be therefore construed as limiting the scope of the present application. It should be noted that, for those of ordinary skill in the art, several variations and modifications can be made without departing from the concept of the present disclosure, which also fall within the scope of the present disclosure. Therefore, the protection scope of the present application shall be defined by the appended claims.

What is claimed is:

1. A display panel, comprising:

a display area;

a driver transistor array substrate located on the display area;

a plurality of scanning lines located on the display area, each of the scanning lines is connected to at least one driver transistor so as to control pixels driven by the driver transistors respectively, and the display area is divided into a first display area and a second display area according to one diagonal line of the driver transistor array substrate; and a control electrode driver chip comprising a plurality of amplifying circuits and being connected to the scanning lines through output ports, each of the output ports is for controlling at least one scanning line, each output port with a number of controlled pixels greater than a first preset value is connected to the scanning line through one amplifying circuit, and each output port with a number of controlled pixels less than or equal to the first preset value is not connected to the scanning line through the amplifying circuit.

2. The display panel according to claim 1, wherein the plurality of scanning lines comprise a first scanning line located on the diagonal line, the first scanning line is for driving pixels on the diagonal line of the driver transistor array substrate; both ends of the diagonal line intersect with an edge of the driver transistor array substrate, pixels at the intersections are pixels driven by a starting point of the first scanning line and pixels driven by an end point of the first scanning line, and the first scanning line is connected to a control electrode of one driver transistor among a row of driver transistors.

3. The display panel according to claim 1, wherein pixels driven by each of the scanning lines are arranged into line segments, and the line segments are parallel to one another; pixels at both ends of each line segment are respectively located at an edge of one side of the first display area or an edge of one side of the second display area; intervals of pixels in an identical row driven by one of two adjacent scanning lines among the scanning lines on both sides of the diagonal line are equal; and each output port of the control electrode driver chip controls two scanning lines.

4. The display panel according to claim 3, wherein each output port is for controlling a pair of scanning lines, and each pair of scanning lines comprises:

a second scanning line for driving pixels located in the first display area; and a third scanning line for driving pixels located in the second display area.

5. The display panel according to claim 4, wherein the two scanning lines in each pair of scanning lines drive an identical number of pixels.

6. The display panel according to claim 3, wherein a number of the scanning lines in the first display area is equal to that of the scanning lines in the second display area.

7. The display panel according to claim 1, wherein the amplifying circuit comprises an operational amplifier.

8. The display panel according to claim 1, wherein the display panel further comprises a plurality of control electrode control chips; each of the control electrode control chips is respectively connected to one scanning line and one output port of the control electrode driver chip; and a control electrode control chip receives a driving signal of the control electrode driver chip so as to control corresponding pixels.

9. The display panel according to claim 1, wherein the control electrode driver chip is a gate driver chip.

10. A display panel, comprising:

a display area;

a driver transistor array substrate located on the display area;

a plurality of scanning lines located on the display area, each of the scanning lines is connected to at least one driver transistor to control pixels respectively driven by the driver transistors, the display area is divided into a first display area and a second display area according to one diagonal line of the driver transistor array substrate, pixels driven by each of the scanning lines is arranged into line segments, all the line segments are parallel to one another, and pixels at both ends of each line segment are respectively located on an edge of one side of the first display area or an edge of one side of the second display area; and a gate driver chip comprising a plurality of amplifying circuits for enhancing a driving capability of signals output to the scanning lines by output ports, each output port of the gate driver chip is for controlling two scanning lines, each output port with a number of controlled pixels greater than a first preset value is connected to a scanning line through one amplifying circuit, and each output port with a number of controlled pixels less than or equal to the first preset value is not connected to the scanning line through the amplifying circuit.

11. A display device, comprising:

a display control circuit; and a display panel, the display control circuit is connected to the display panel so as to control the display panel, and the display panel comprises:

a display area;

a driver transistor array substrate located on the display area;

a plurality of scanning lines located on the display area, each of the scanning lines is connected to at least one driver transistor, and the display area is divided into a first display area and a second display area according to one diagonal line of the driver transistor array substrate; and a control electrode driver chip comprising a plurality of amplifying circuits and being connected to the scanning lines through output ports, each of the output ports is for controlling at least one scanning line, each output port with a number of controlled pixels greater than a first preset value is connected to the scanning line through one amplifying circuit, and each output port with a number of controlled pixels less than or equal to the first preset value is not connected to the scanning line through the amplifying circuit.

12. The display device according to claim 11, wherein the display control circuit is connected to the control electrode driver chip in the display panel; and the display control circuit controls the scanning lines in the display panel to be switched on and off by the control electrode driver chip.

13. The display device according to claim 11, wherein the plurality of scanning lines comprise a first scanning line located on the diagonal line, the first scanning line is for driving pixels on the diagonal line of the driver transistor array substrate; both ends of the diagonal line intersect with an edge of the driver transistor array substrate, pixels at the intersections are pixels driven by a starting point of the first scanning line and pixels driven by an end point of the first scanning line, and the first scanning line is connected to a control electrode of one driver transistor among a row of driver transistors.

14. The display device according to claim 11, wherein pixels driven by each of the scanning lines are arranged into line segments, and the line segments are parallel to one another; pixels at both ends of each line segment are respectively located at an edge of one side of the first display area or an edge of one side of the second display area; intervals of pixels in an identical row driven by one of two adjacent scanning lines among the scanning lines on both sides of the diagonal line are equal; and each output port of the control electrode driver chip is for controlling two scanning lines.

15. The display device according to claim 14, wherein each output port is for controlling a pair of scanning lines, and each pair of scanning lines comprises:

a second scanning line for driving pixels located in the first display area; and a third scanning line for driving pixels located in the second display area.

16. The display device according to claim 15, wherein the two scanning lines in each pair of scanning lines drive an identical number of pixels.

17. The display device according to claim 14, wherein a number of the scanning lines in the first display area is equal to that of the scanning lines in the second display area.

18. The display device according to claim 11, wherein the amplifying circuit comprises an operational amplifier.

19. The display device according to claim 11, wherein the display device further comprises a plurality of control electrode control chips; each of the control electrode control chips is respectively connected to one scanning line and one output port of the control electrode driver chip; and a control electrode control chip receives a driving signal of the control electrode driver chip so as to control corresponding pixels.

20. The display device according to claim 11, wherein the control electrode driver chip is a gate driver chip.

* * * * *